US006497083B1

(12) United States Patent
Garwood et al.

(10) Patent No.: US 6,497,083 B1
(45) Date of Patent: Dec. 24, 2002

(54) PACKAGING APPARATUS

(75) Inventors: Ronald George Garwood, Reading (GB); Michael William Ellis, Reading (GB); Brian Keith Hansford, Wokingham (GB)

(73) Assignee: Electro-mec (Reading) Ltd, Reading (GB)

( * ) Notice: Subject to any disclaimer, the term of this patent is extended or adjusted under 35 U.S.C. 154(b) by 0 days.

(21) Appl. No.: 09/566,444

(22) Filed: May 8, 2000

(30) Foreign Application Priority Data

Nov. 10, 1999 (DE) ..... 29919756

(51) Int. Cl.[7] ..... B65B 1/04

(52) U.S. Cl. ..... 53/244; 53/246; 53/247; 53/534; 53/539; 221/93; 221/95

(58) Field of Search ..... 53/202, 235, 244, 53/246, 247, 249, 475, 539, 900, 534, 250; 221/93, 95, 68

(56) References Cited

U.S. PATENT DOCUMENTS 1,383,623 A * 7/1921 Groves ..... 53/244
2,227,378 A * 12/1940 Milmoe et al. ..... 53/534
2,385,311 A * 9/1945 Strauss ..... 221/93
3,526,743 A * 9/1970 Spisak ..... 219/68
3,545,164 A * 12/1970 Middleton ..... 53/539
3,789,575 A * 2/1974 Bross ..... 53/534
4,101,284 A * 7/1978 Difiglio et al. ..... 221/95
4,541,524 A * 9/1985 McGill et al. ..... 53/534
5,329,749 A * 7/1994 Yamamoto et al. ..... 53/246
5,415,321 A * 5/1995 Gehlert et al. ..... 221/95
5,611,193 A * 3/1997 Farrelly ..... 53/534
5,737,902 A * 4/1998 Aylward ..... 53/246
5,829,632 A * 11/1998 Gehlert et al. ..... 221/93
5,848,514 A * 12/1998 Edwards et al. ..... 53/249

* cited by examiner

*Primary Examiner*—John Sipos
*Assistant Examiner*—Louis Huynh
(74) *Attorney, Agent, or Firm*—Robert W. J. Usher

(57) ABSTRACT

Apparatus for feeding items of pharmaceutical product to pockets in a continuously travelling web for the production of blister packs has a plurality of product delivery chutes mounted on a moving carriage having delivery gates for releasing product from the delivery chutes. The carriage cycles the delivery chutes from a stationary position under stationary metering chutes, where product is transferred into the delivery chutes, accelerating and lowering them into alignment with pockets in the travelling web, where product is released, and raising and returning the delivery chutes to the stationary position to repeat the cycle.

13 Claims, 4 Drawing Sheets

PACKAGING APPARATUS

FIELD OF THE INVENTION

This invention relates to packaging apparatus for packaging small products into a multi-pocket blister pack. This kind of apparatus is commonly used for packaging pharmaceutical products, such as capsules and tablets. Such products may take a variety of different shapes and sizes, and may be made out of a variety of different materials with different properties of strength, hardness and, particularly in the case of soft gelatine capsules, tackiness.

BACKGROUND OF THE INVENTION

Packaging machines of this kind typically include four stations on a track along which a continuous web, made for example of PVC (polyvinylchloride), passes. The first station is typically a pocket-forming station at which a two-dimensional matrix of pockets are either thermo-formed, to produce pockets of a more or less exact product shape with well defined edges, or cold-formed, to produce broad and shallow concave pockets substantially larger in area than the individual items of product. The second station is a feeding station, at which a plurality of chutes deliver product to the pockets across the web. At the third station, a top closure foil is applied across the top of the web, sealing the product into the pockets. At the fourth and final station, individual blister packs are punched out of the continuous web.

This invention is particularly concerned with feeding apparatus which may be located at the feeding station.

There are two general types of machine known in the art. In a continuous motion machine, the web moves continuously under dedicated vertical feed chutes at the feeding station to allow product to fall freely into the matrix of pockets as the web travels under the outlets of the chutes. In an intermittent motion machine, indexed movements of the web past the feeding station allow it to be fed while stationary from chutes in which, typically, pairs of sliding gates meter a single product at a time into each pocket.

In each case the feed chutes are fed from a hopper which is vibrated to allow product to drop into the tops of the respective chutes.

Intermittent feed machines generally operate at about 45–60 cycles per minute. Continuous motion machines are rated according to the speed of the web, which typically travels at from 10–14 meters per minute. A continuous motion machine can give faster output, especially for smaller packs, but gives problems with some products, such as soft capsules, and with the wider cold-formed pockets where the flat portions of the web between the pockets cannot precisely cut off the supply of single products as the pockets pass under the delivery chutes. Continuous motion also tends to give a greater reject rate, as the product is more likely to be chipped or sheared if it is not delivered cleanly into each pocket. The efficiency of a continuous motion machine may be 98.5%, as against 99.5% or better for an intermittent motion machine.

SUMMARY OF THE INVENTION

This invention is concerned with improving the efficiency of feeding apparatus for a continuous motion packaging line. Product feeding apparatus for delivering items of product into pockets in a continuously travelling web comprises a plurality of product delivery chutes positioned over the paths of the products in the web. According to the invention, the product delivery chutes are mounted on a carriage that reciprocates along the direction of travel of the web in a cycle that includes a stage in which the carriage synchronises its speed with the speed of the web and releases the items of product while the delivery chutes are positioned over corresponding pockets in the travelling web.

Other preferred features of the invention will be apparent from the following description and appended claims.

BRIEF DESCRIPTION OF THE DRAWINGS

Aspects of the invention are further described hereunder, with reference to an embodiment which is illustrated, by way of example only, in the accompanying drawings, in which.

DESCRIPTION OF PARTICULAR EMBODIMENT

Figure 1:
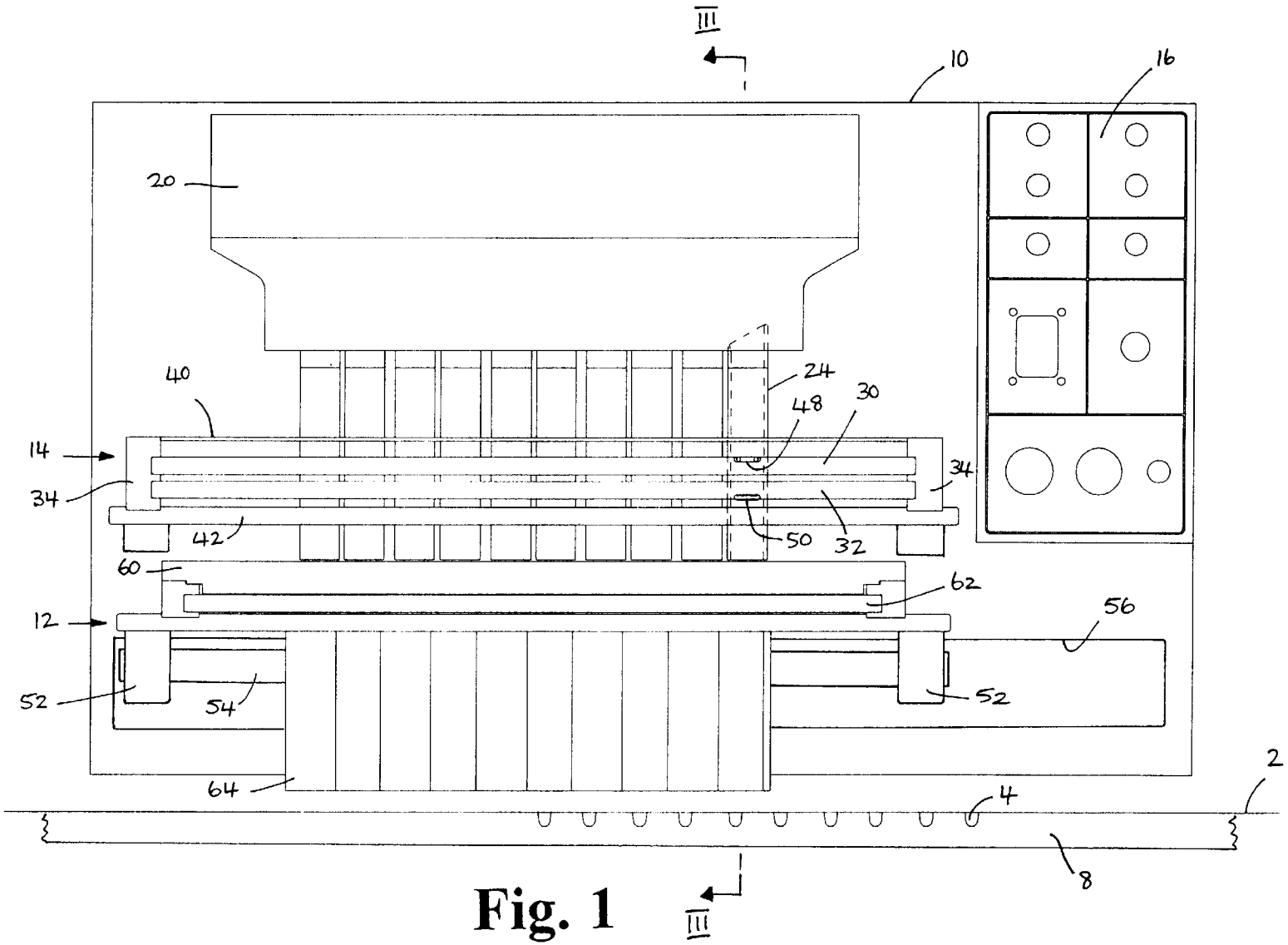
FIG. 1 is a front elevation of product feeding apparatus at a product feeding station of a four station continuous motion pharmaceutical product packaging line, with a reciprocating carriage temporarily stationary at one end of its path for receiving items of product, such as capsules or tablets, from a metering assembly.
Figure 2:
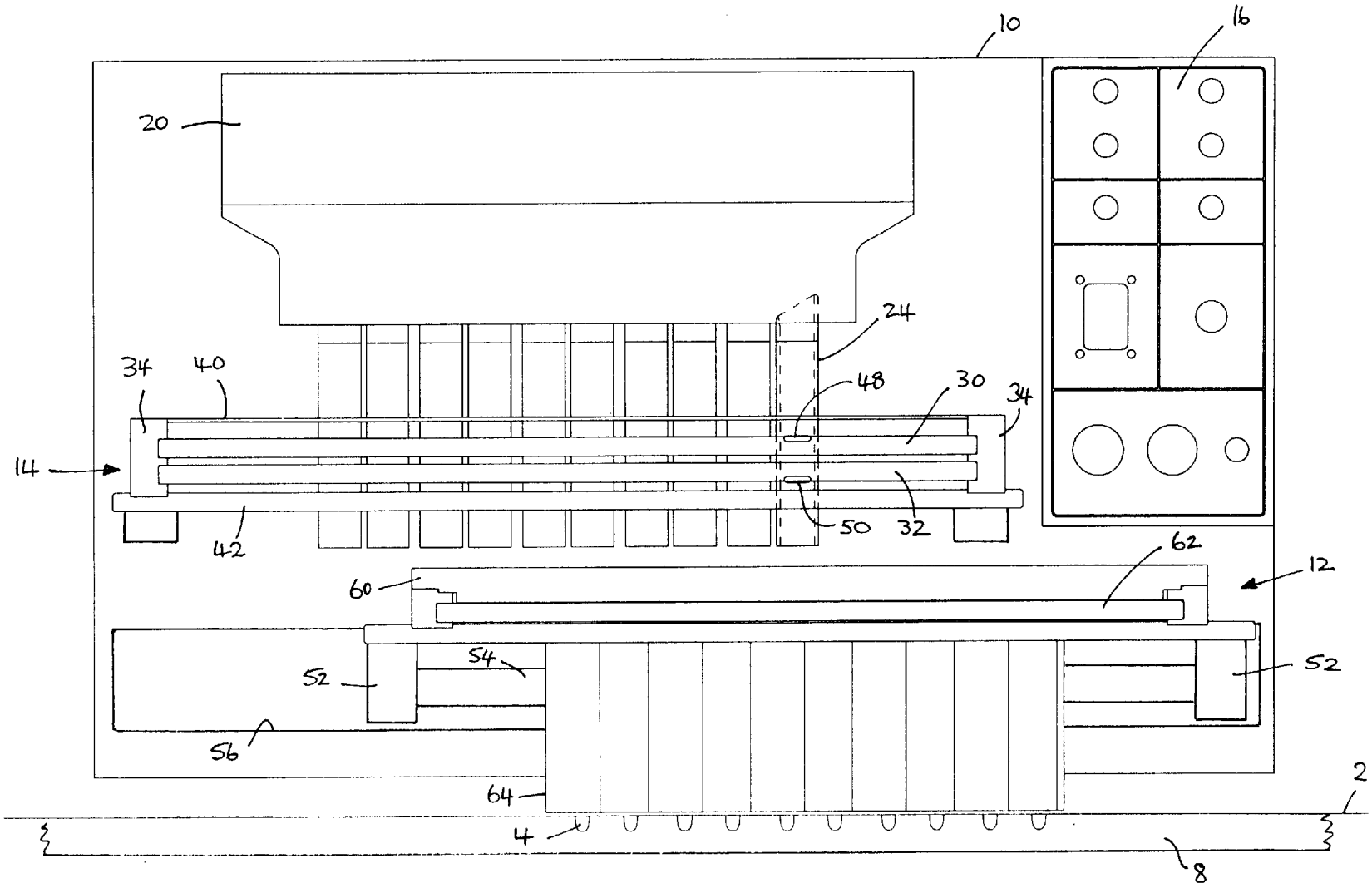
FIG. 2 is a similar view of the same apparatus but with the reciprocating carriage in motion and located for delivering items of product to the travelling web.
Figure 3:
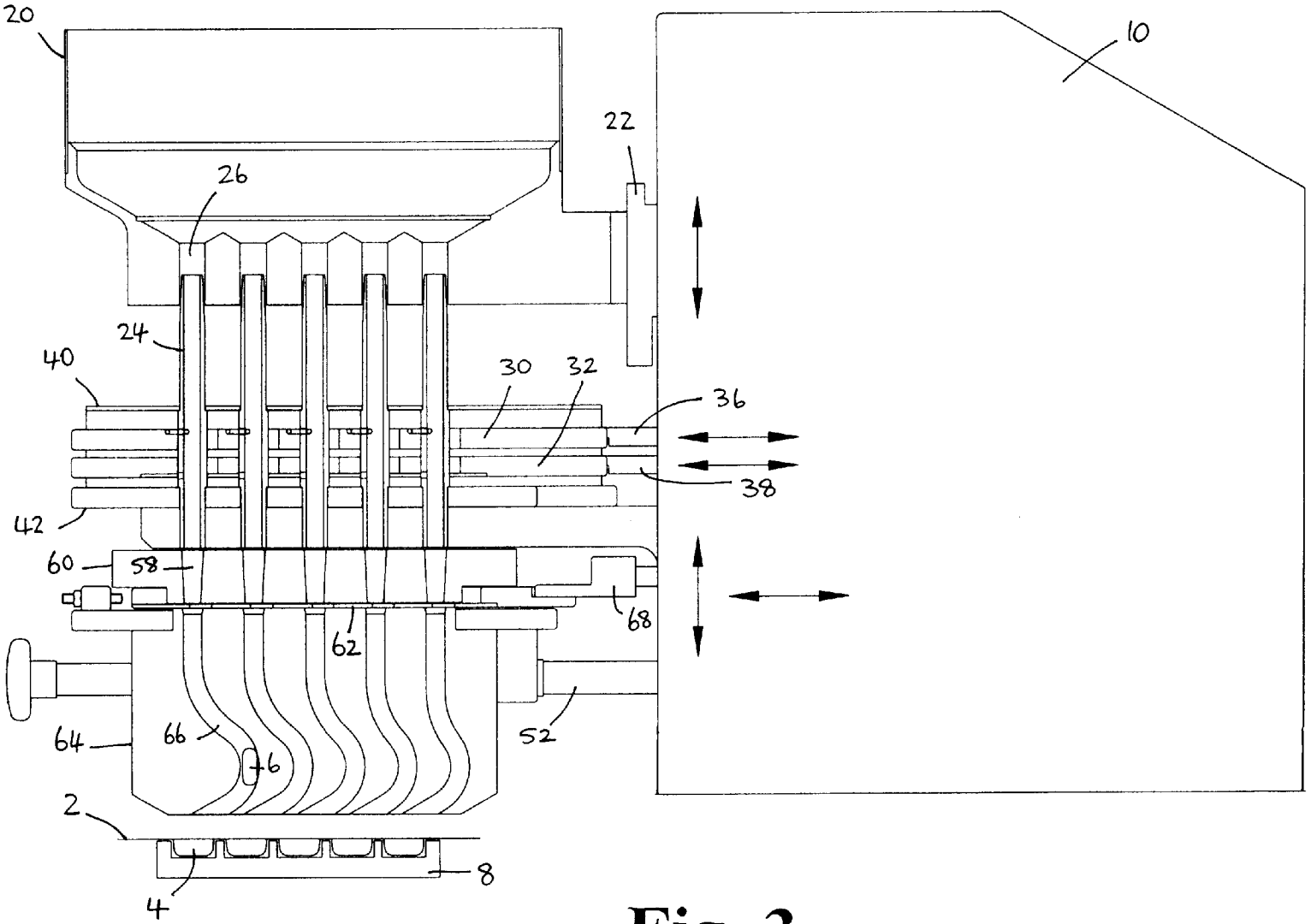
FIG. 3 is a cross-section through the metering assembly and carriage taken on the line III—III of FIG. 1.
Figure 4:
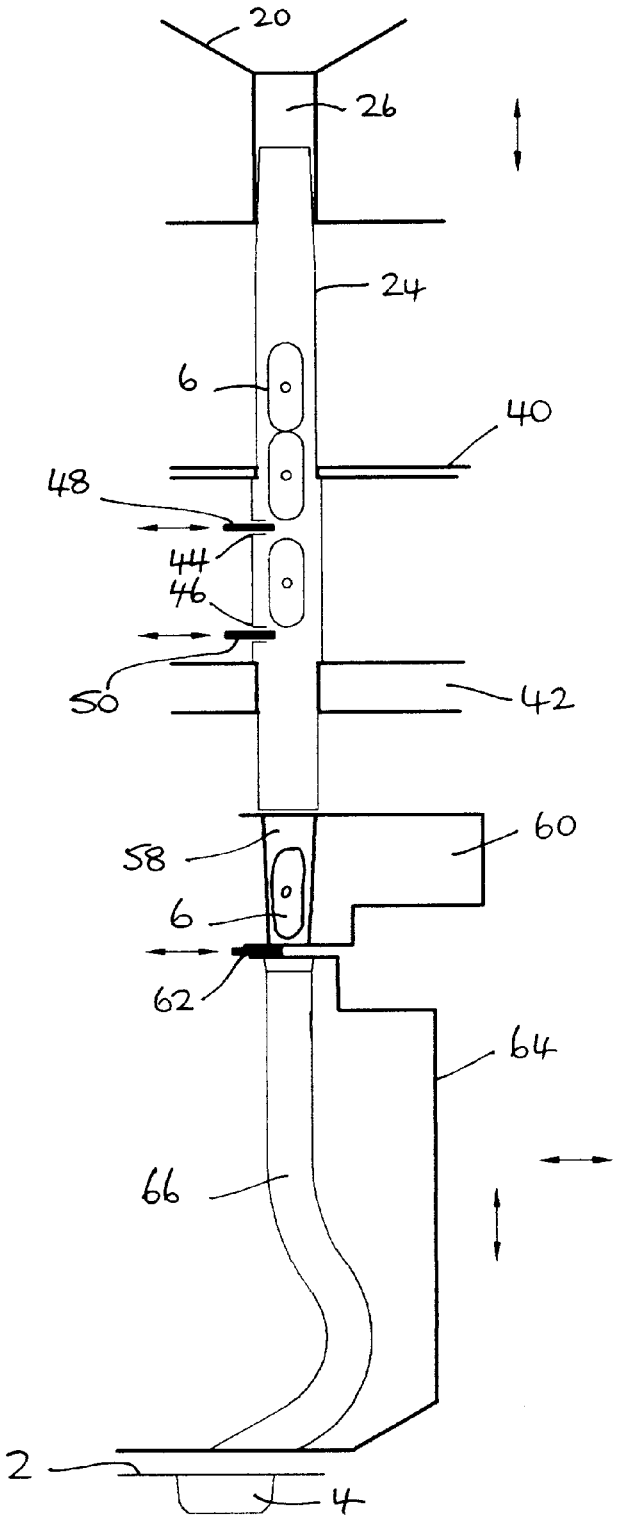
FIG. 4 is an enlarged detail view of part of FIG. 3, showing one metering chute above one corresponding delivery chute.

The drawings show a travelling PVC web 2, moving from left to right in FIGS. 1 and 2, provided with a two-dimensional matrix of thermo-formed pockets 4 for receiving pharmaceutical capsules 6 (FIG. 4). The web travels over a stationary guide track 8.

Product feeding apparatus in accordance with the invention is located at a feeding station and stands on one side of the track 8. It includes a stationary main housing 10, from which a reciprocating carriage 12 projects over the travelling web, and a metering assembly 14 projects over the reciprocating carriage. The housing includes a control and warning lamp panel 16.

Above the metering assembly 14, a hopper bin 20 is carried by a hopper mounting 22 which vibrates vertically to shake items of product into metering chutes 24 which extend downwardly from wells 26 in the bottom of the hopper. The chutes are a loose fit in the wells so that the hopper can vibrate vertically while the chutes remain stationary.

The metering assembly around the metering chutes includes an upper metering gate 30 and a lower metering gate 32, each carried at its edges in low friction side guides 34 so that they can independently slide to and fro driven by respective upper metering gate operating arm 36 and lower metering gate operating arm 38.

Cover plate 40 and base plate 42, respectively above and below the two metering gates, are fixed to the side guides 34 and carry the stationary metering chutes 24. These are provided with upper wall slots 44 and lower wall slots 46 (FIG. 4), spaced apart by the distance occupied in the metering chute by the specific number of items to be delivered at one time, in this case the length of one capsule 6. The upper metering gate carries a series of elastomeric members 48, one for each slot 44, which can be moved into and out of that slot according to the sliding motion of the gate controlled by operating arm 36, to allow a capsule 6 to pass or to retain it. Lower metering gate 32 carries a corresponding stainless steel portion 50 corresponding to each slot 46, similarly to allow or prevent the passage of product items 6 through the chutes 24.

By alternately operating the two sliding gates 30 and 32, single capsules can be allowed to fall at the appropriate time from the lower ends of the delivery chutes.

The reciprocating carriage 12 is mounted on cantilever support arms 52 which project rigidly outwards over the web guide track 8 from a reciprocating drive block 54 inside the housing 10. A slot 56 for the support arms is long enough to allow the drive block to travel at least 80 mm to and fro in parallel with the motion of the web, and at least 10 mm vertically.

FIG. 1 shows the reciprocating carriage at its furthest distance upstream, with respect to the travelling web, and at the top of its vertical travel. In this position the carriage receives product metered from chutes 24 into the upper portions 58 of delivery chutes formed in a support plate 60. Below this is a delivery gate 62. Below that is a composite plastic moulding 64 which forms a nest of delivery chute lower portions 66 aligned with the upper portions 58. The delivery gate 62 is formed with a plurality of apertures corresponding to the number and position of the delivery chutes, and is slid by delivery gate operating arm 68 to and fro to close or open the delivery chutes at the appropriate times.

All mechanical power to the four station packaging line is provided by a single main drive shaft which extends under all four stations. Power is taken to each station by suitable gearing. Rotary encoders and programmable logic controls allow the necessary motions to occur at the appropriate times. The gate operating arms 36, 38 and 68 are operated pneumatically, with return springs. From the position of the carriage shown in FIG. 1, the drive block 54 is accelerated to synchronise the carriage speed with that of the web, while the carriage is lowered until the lower portions 66 of the delivery chutes are just above respective pockets 4. The delivery gate discharges the single capsule carried in the upper portion of each delivery chute, after which the carriage is slowed, raised and returned to the position shown in FIG. 1 to collect another capsule from the metering assembly and repeat the cycle. The timings of the different gates are coordinated with the motion of the carriage and the web to maximise throughput and minimise packaging errors.

What is claimed is:

1. Product feeding apparatus for delivering items of product into pockets in a continuously travelling web, comprising a plurality of product delivery chutes positioned over paths of travel of the pockets in the web, wherein the product delivery chutes are mounted on a moving carriage, and comprising reciprocating means operatively connected to said carriage for reciprocating said carriage in forward and return strokes along a direction of travel of the web in a cycle that includes a first stage synchronizing a speed of forward travel of the carriage with a speed of the web while positioning the delivery chutes over corresponding pockets in the travelling web and simultaneously releasing the items of product, said apparatus also comprising a stationary product metering assembly separate from the carriage and comprising means for releasing a specific number of items of product from a product supply at one time into each product delivery chute when the carriage is adjacent the metering assembly, and said delivery chutes include retaining means for temporarily retaining said specific number of items of product in said delivery chutes said cycle including a second stage in which the reciprocating means returns and positions the carriage adjacent to the metering assembly enabling said carriage to collect the specific number of items of product from the metering assembly for delivery.

2. Apparatus according to claim 1 wherein the carriage collects the specific number of items of product in upper portions of the respective delivery chutes and said retaining means includes a delivery gate for temporarily retaining the specific number of items of product before releasing said specific number of items of product into the pockets in the web through lower portions of the delivery chutes.

3. Apparatus according to claim 1 wherein the means for releasing a specific number of items of product at one time includes a plurality of metering chutes and sequentially operating metering gates which open each metering chute alternately whereby to temporarily trap the specific number of items of product for release between the gates.

4. Apparatus according to claim 1 wherein said second stage of said cycle includes a vertical motion in which said carriage is raised to collect the specific number of items of product from the metering assembly and lowered to deliver the specific number of items of product into the pockets in the web.

5. Apparatus to claim 1 wherein the carriage is stationary while it collects the product from the metering assembly.

6. Apparatus according to claim 1 wherein the specific number of items of product is one.

7. Continuous motion pharmaceutical blister pack product feeding apparatus comprising a plurality of pharmaceutical product delivery chutes positioned over a guide track for guiding a continuously travelling web having product-receiving pockets formed therein whereby said pockets pass under said delivery chutes, wherein said chutes are mounted on and move with a moving carriage, and said apparatus comprises means operatively connected to the carriage to move the carriage through a cycle having a forward stroke in which the chutes are accelerated from a rest position to the speed of the web and lowered to the pockets, and a return stroke in which the chutes are raised from the web and returned to the rest position; and wherein said chutes are provided with gates for releasing items of product into the pockets while the chutes are travelling at web speed and lowered to the pockets, and a stationary product metering assembly at said rest position having means for releasing a specific number of items of product into each product delivery chute while the chutes are raised at the rest position.

8. Product feeding apparatus for delivering items of product into pockets in a continuously travelling, horizontal web, comprising:

a plurality of product delivery chutes mounted on a movable carriage and positioned over paths of travel of the pockets in the web;

a horizontally stationary product reservoir including a stationary product metering assembly which projects over the carriage and comprises metering chutes and means for releasing a specific number of items of a product at one time from each metering chute into each product delivery chute when aligned thereunder;

a retaining means for temporarily retaining said specific number of items of product in said product delivery chutes; and reciprocating means for reciprocating said carriage in forward and return strokes along a direction of travel of the web between a product collecting position adjacent the stationary metering assembly, in which each product delivery chute is aligned under each metering chute so that the metering assembly can release a specific number of items of product into each product delivery chute, and a product delivery position remote from the stationary metering assembly, in which the reciprocating means synchronizes a speed of travel of the carriage with a speed of the web and positions the delivery chutes over corresponding pockets in the travelling web so that said retaining means releases the specific number of items of product into the corresponding pockets.

9. Apparatus according to claim 8 wherein said carriage is raised during said return stroke to collect the specific number of items of product from the metering assembly and lowered during said forward stroke to deliver the specific number of items of product into the pockets in the web.

10. Apparatus according to claim 8 wherein the carriage collects the specific number of items of product in upper portions of the respective delivery chutes and said retaining means includes delivery gate for temporarily retaining the specific number of item of product before releasing said specific number of items of product into the pockets in the web through lower portions of the delivery chutes.

11. Apparatus according to claim 8 wherein the means for releasing a specific number of items of product at one time includes a plurality of metering chutes and sequentially operating metering gates which open each metering chute alternately whereby to temporarily trap the specific number of items of product for release between the gates.

12. Apparatus according to claim 8 wherein the carriage is stationary while it collects the product from the metering assembly.

13. Apparatus according to claim 8 wherein the specific number of items of product is one.

* * * * *